US006447390B1

(12) United States Patent
O'Hagin

(10) Patent No.: US 6,447,390 B1
(45) Date of Patent: Sep. 10, 2002

(54) METHOD AND APPARATUS FOR ROOF VENTILATION

(76) Inventor: Harry Theodore O'Hagin, P.O. Box 126, Sebastopol, CA (US) 95473-0126

( * ) Notice: Subject to any disclaimer, the term of this patent is extended or adjusted under 35 U.S.C. 154(b) by 0 days.

(21) Appl. No.: 08/960,166

(22) Filed: Oct. 29, 1997

Related U.S. Application Data

(63) Continuation of application No. 07/924,738, filed on Aug. 4, 1992, now abandoned.

(51) Int. Cl.[7] ..... F24F 7/02

(52) U.S. Cl. ..... 454/250; 454/366; 454/367; 454/368

(58) Field of Search ..... 454/250, 339, 454/365, 366, 367, 368

(56) References Cited

U.S. PATENT DOCUMENTS

| | | | | |
|---|---|---|---|---|
| 938,930 A | | 11/1909 | Wiest | |
| 1,381,630 A | | 6/1921 | Goodrich | |
| 1,496,670 A | * | 6/1924 | Floyd | 454/250 |
| 2,692,548 A | * | 10/1954 | Knorr | 454/366 |
| 2,905,072 A | | 9/1959 | Oswald | 98/29 |
| 3,093,059 A | * | 6/1963 | Metz | 454/366 |
| 4,090,435 A | * | 5/1978 | Vallée | 454/365 |
| 4,297,818 A | * | 11/1981 | Anderson | 454/366 X |
| 4,498,267 A | | 2/1985 | Beck | 52/555 |
| 4,803,816 A | * | 2/1989 | Klöber | 454/368 X |
| 4,899,505 A | | 2/1990 | Williamson et al. | 52/199 |
| 5,054,254 A | | 10/1991 | Sells | 52/199 |
| 5,326,318 A | | 7/1994 | Rotter | 454/365 |
| 5,549,513 A | | 8/1996 | Thomas et al. | 454/365 |
| 5,593,348 A | | 1/1997 | Rickert | 454/365 |
| 5,697,842 A | | 12/1997 | Donnelly | 454/365 |
| 5,738,581 A | | 4/1998 | Rickert et al. | 454/365 |
| 5,766,071 A | | 6/1998 | Kirkwood | 454/185 |

FOREIGN PATENT DOCUMENTS

| | | | | |
|---|---|---|---|---|
| DE | 2128035 | * | 12/1972 | 454/339 |
| FR | 911724 | * | 7/1946 | 454/339 |
| FR | 2 476 722 | | 8/1981 | |
| FR | 2 683 570 | | 5/1993 | |
| FR | 2 683 571 | | 5/1993 | |
| FR | 2 687 181 | | 8/1993 | |
| GB | 593645 | | 10/1947 | |
| GB | 1 336 505 | | 11/1973 | |
| GB | 1 393 977 | | 5/1975 | |
| GB | 1 591 627 | | 6/1981 | |
| GB | 2 145 131 B | | 3/1985 | |
| GB | 2 199 860 A | | 7/1988 | |
| GB | 2 236 775 B | | 4/1991 | |
| GB | 2 243 169 A | | 10/1991 | |
| GB | 2 262 295 A | | 6/1993 | |
| GB | 2 262 949 A | | 7/1993 | |
| NL | 9000176 A | | 8/1991 | |
| WO | WO 9945327 | | 9/1999 | |

* cited by examiner

*Primary Examiner*—Harold Joyce
(74) *Attorney, Agent, or Firm*—Knobbe, Martens, Olson & Bear, LLP

(57) ABSTRACT

A roof ventilation apparatus provides a vent tile shaped like a roof tile itself, and thus is inconspicuous and unobtrusive when installed, and blends with the field and/or ridgeline tile. The base of the unit may be used to mark the opening, after which a hole is cut in the roof, roofing cement is applied to the base flange, and the base is secured in place. The unit cover is then placed over the base and the remainder of the roof tile application is completed.

10 Claims, 8 Drawing Sheets

METHOD AND APPARATUS FOR ROOF VENTILATION

RELATED APPLICATION

This application is a continuation of copending U.S. patent application Ser. No. 07/924,738 filed Aug. 4, 1992 abandoned.

BACKGROUND OF THE INVENTION

1. Field of the Invention

This invention relates generally to building ventilation, and more specifically to an improved method and apparatus for constructing and installing roof ventilation units for attics and other confined spaces.

2. Description of the Prior Art

It is desirable to ventilate attics and other confined spaces in a building unit to remove accumulated heat and moisture. For example, solar radiation is the principal source of heat in an unventilated attic of a home. Temperatures can reach one hundred fifty degrees Fahrenheit or more when the sun is at its zenith, even when the outside temperature is in the ninety to one hundred degree range. In cold climate areas, combinations of high humidity and low outside temperatures can cause frost to form and accumulate on the underside of roof sheathing.

As the threat of indoor air pollution becomes increasingly prevalent, more and more people are concerned about properly ventilating their homes. Unfortunately, venting a tile roof presents architects, roofers, and contractors with a serious challenge; how to properly ventilate without leakage, and without destroying the integrity of the original roof design.

Numerous mechanical devices have been designed to be installed in a roof to ventilate such an attic space. However, no known devices utilize naturally occurring convection effects and pressure differentials to ventilate a space, while still maintaining a desired aesthetic consistency with the roof covering material.

SUMMARY OF THE INVENTION

The method and apparatus for roof ventilation of this invention provides a cloaked vent tile which can be used on curved or flat tile roofs to vent attic space, space between rafters on bolted ceilings, or other difficult to vent hip or gable roofs where tile can safely be utilized. The inventive apparatus is shaped like a roof tile itself, and thus is inconspicuous and unobtrusive when installed. The inventive unit blends with the field and/or ridgeline tile, has no lead flanges to solder and will eliminate the cutting of tile for fitting, thereby enhancing the beauty of a tile roof while reducing labor costs and risk of leaks. The"invisibility" and simple procedure of installation allows the use of any number of units to fill any requirement.

The inventive device simply takes the place of a field or ridgeline tile. Units are installed between rafters for best results. The base of the unit may be used to mark the opening, after which a hole is cut in the roof, roofing cement is applied to the base flange, and the base is nailed or otherwise secured in place. It is common roofing practice to seal around the base with plastic cement and strips of felt or fabric. Finally, the unit cover is placed over the base and the remainder of the roof tile application is completed. The unit can be installed at both the eave and ridge line to provide natural air convection, allowing the roof to breath year round, expelling damaging hot air and moisture laden air.

The inventive apparatus utilizes standard size vent openings (e.g., 25, 50 or 100 square inch screened openings) installed on the roof surface. The vent base and cap are preferably made of galvanized sheet metal (e.g., 26 gauge galvanized steel with #10 mesh galvanized wire insect screen) or copper (e.g., 16 ounce copper sheet with #10 mesh copper screen). The vent caps may be painted or otherwise fused with color to match the surrounding (standard) tiles.

Convection is one of the ways an attic can breath. This occurs when the air temperature in the attic and the outside air temperature differ, and the elevations of the ventilation openings are at their furthest extremes. As hot air escapes through the ridge of the roof, cooler air enters through the vents along the cornice. This phenomenon occurs even at zero windspeed. Another form of ventilation is air pressure caused by wind. Wind moving over an attic will generate a vacuum in the attic which is the result of negative air pressure on the windward side and positive pressure on the downwind side (check). Air is pulled and pushed through the vents as a result of these pressures allowing the attic to"breath".

When placed strategically on the roof where venting is most important, the inventive vent tiles provide uniform, constant air movement via natural air convection. The result is safe, lead-free, leak proof ventilation.

The vent tiles of this invention are easy to install and functional in design. They blend so unobtrusively with the building, preserving the beauty of the original design. The tiles will not present a fire hazard, and can be used on both new and restored buildings. The cost is comparable with standard ventilation systems, yet they are cheaper to install.

BRIEF DESCRIPTION OF THE DRAWINGS

FIG. 1*a* illustrates an isolated vent base and vent cap;

FIG. 1*b* illustrates the vent as installed on a roof in conjunction with standard complementary mission-style tiles;

FIG. 1*c* illustrates the vent cap being inserted over the vent base; and

FIG. 1*d* is an exploded and partially cutaway perspective view illustrating the air flow pattern from the attic volume through the vent;

FIG. 2*a* illustrates an isolated vent base and vent cap;

FIG. 2*b* illustrates a vent as installed on a roof in conjunction with standard complementary S-style tiles;

FIG. 2*c* illustrates a vent cap being inserted over a vent base; and

FIG. 2*d* is an exploded and partially cutaway perspective view illustrating the air flow pattern from the attic volume through the vent;

DETAILED DESCRIPTION OF A PREFERRED EMBODIMENT

Figure 1A:
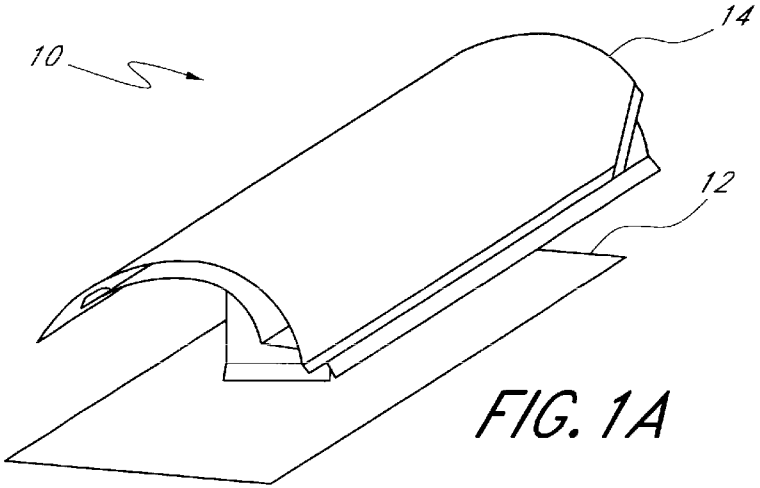
FIGS. 1*a–d* are a series of perspective views of a mission-style cloaked vent tile of the roof vent apparatus of this invention.
Figure 1B:
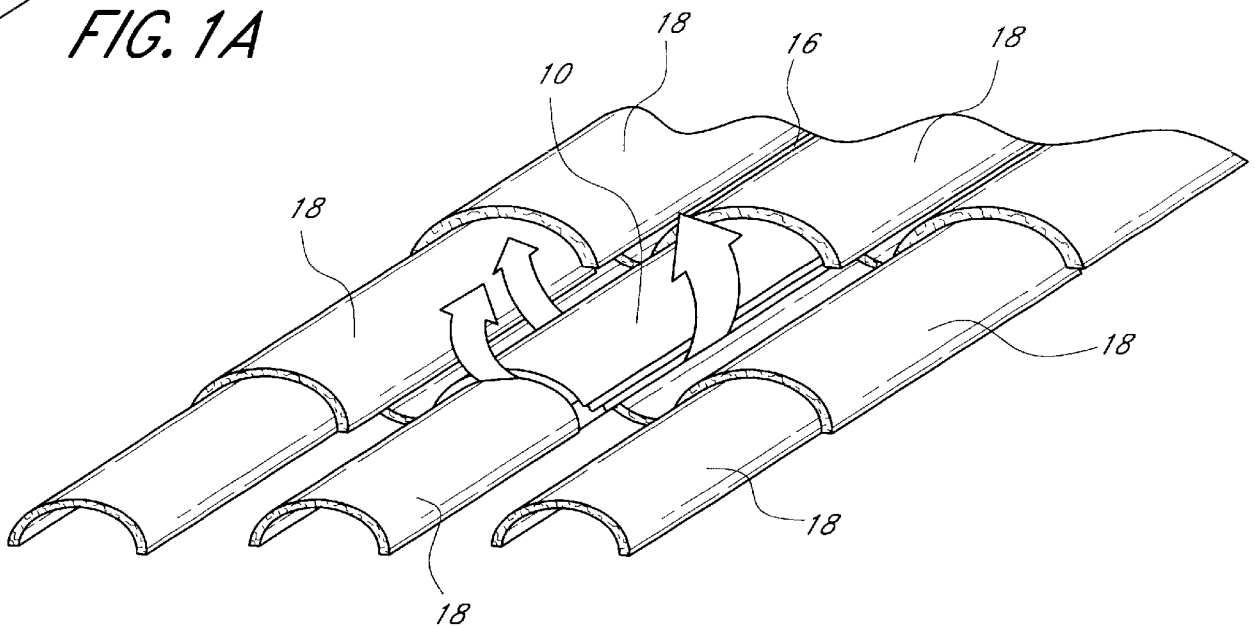
Figure 1D:
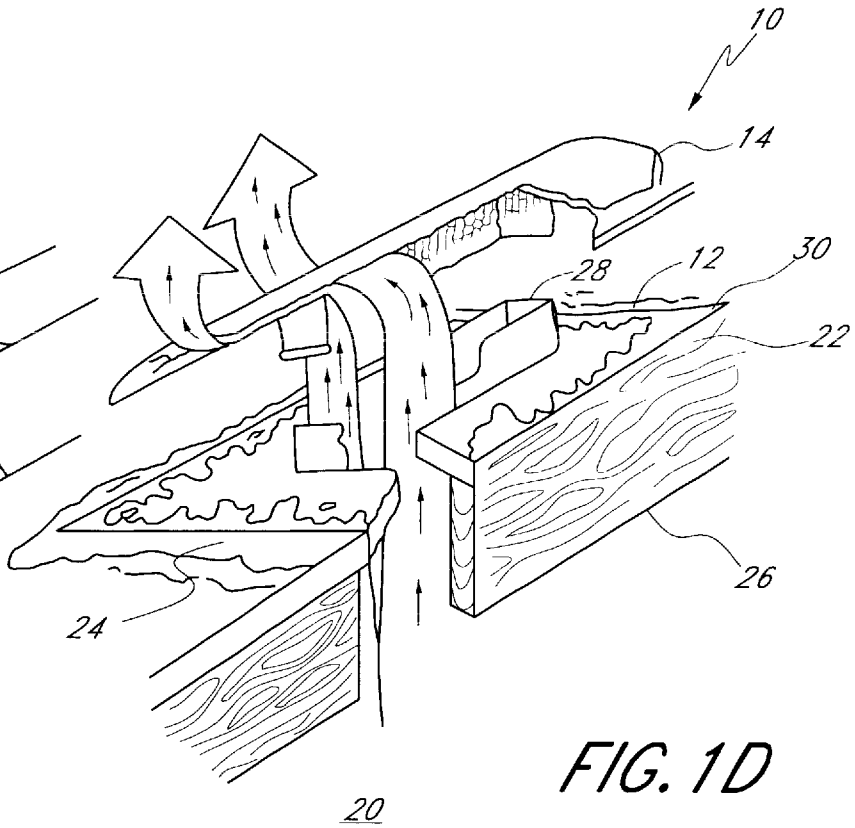
Figure 1C:
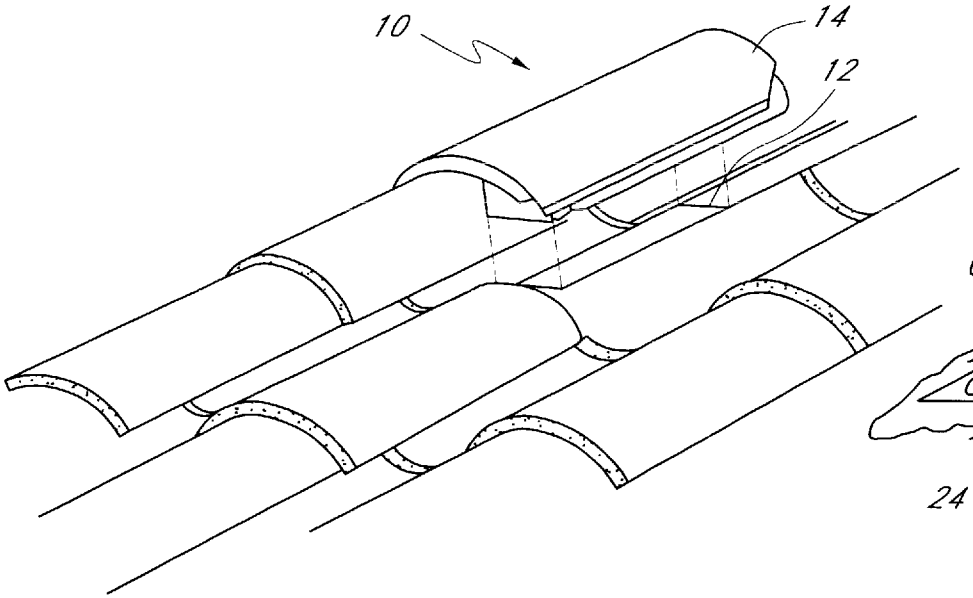

FIGS. 1*a–d* are a series of perspective views of a mission-style cloaked vent tile 10 of the roof vent apparatus of this invention, where FIG. 1*a* illustrates an isolated vent base 12 and vent cap 14, FIG. 1*b* illustrates the vent 10 as installed on a roof 16 in conjunction with and surrounded by standard complementary mission-style tiles 18, and FIG. 1*c* illustrates the vent cap 14 being inserted over the vent base 12.

FIG. 1*d* is an exploded and partially cutaway perspective view illustrating the air flow pattern from the attic volume 20 through the vent 10. This view also serves to illustrate the installation steps:

Vent base 12 is positioned on roof deck 22 and roof underlayment 24 between roof rafters 26. Vent base opening 28 may be used to mark the roof, so that an appropriate-sized hole is cut into the roof. Flange 30 of vent base 12 is installed and sealed to the roof by cement and nails, and additional flashing is placed and sealed around the flange if necessary. The vent cap 14 is then placed over vent base 12, and the adjacent tiles are put into place on the roof in the traditional manner to finish the installation.

Figure 2B:
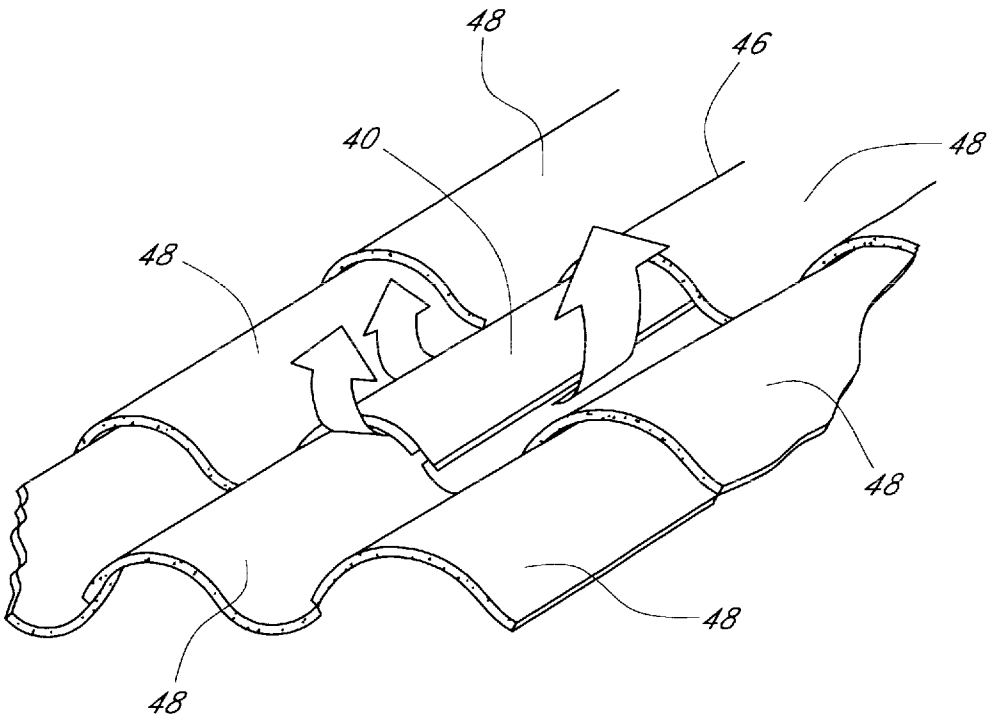
FIGS. 2*a–d* are a series of perspective views of a S-style (clay or concrete) cloaked vent tile of the roof vent apparatus of this invention.
Figure 2A:
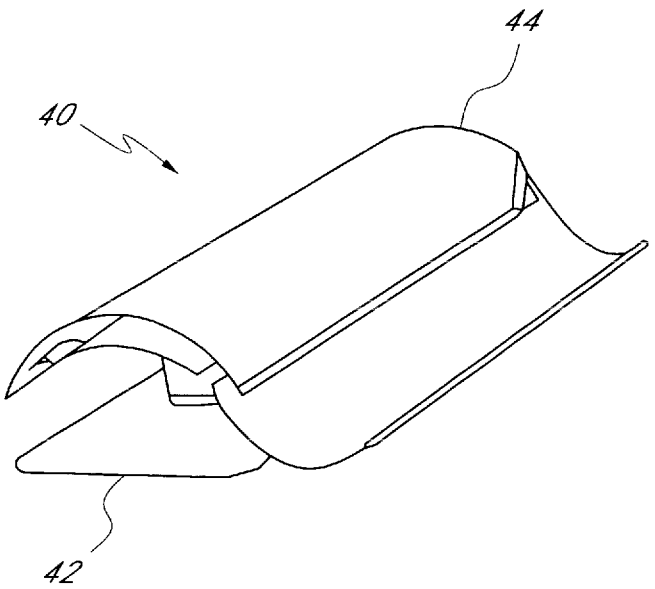
Figure 2D:
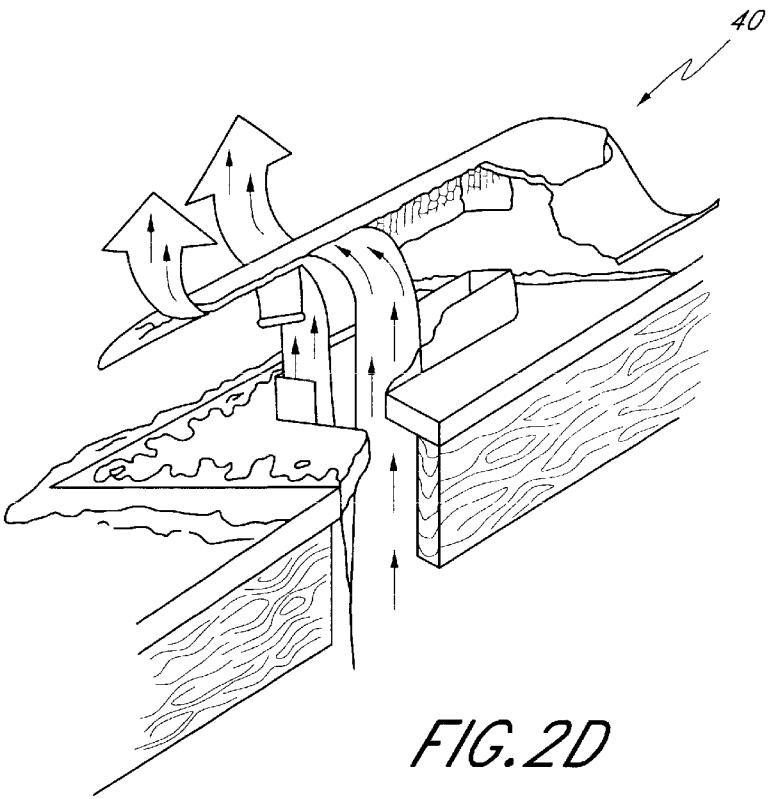
Figure 2C:
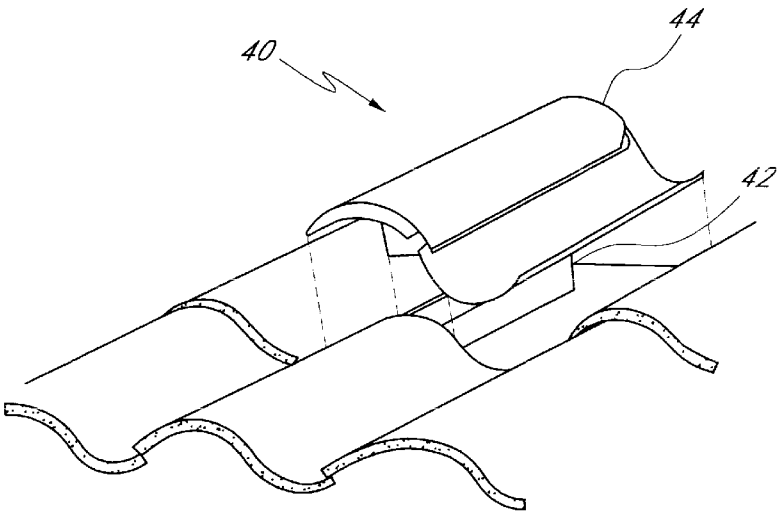

FIGS. 2*a–d* are a series of perspective views of a S-style (clay or concrete) cloaked vent tile 40 of the roof vent apparatus of this invention, where FIG. 2*a* illustrates an isolated vent base 42 and vent cap 44, FIG. 2*b* illustrates a vent 40 as installed on a roof 46 in conjunction with and surrounded by standard complementary S-style tiles 48, FIG. 2*c* illustrates the vent cap 44 being inserted over the vent base 42, and FIG. 2*d* is an exploded and partially cutaway perspective view illustrating the air flow pattern from the attic volume through the vent 40.

Figure 3:
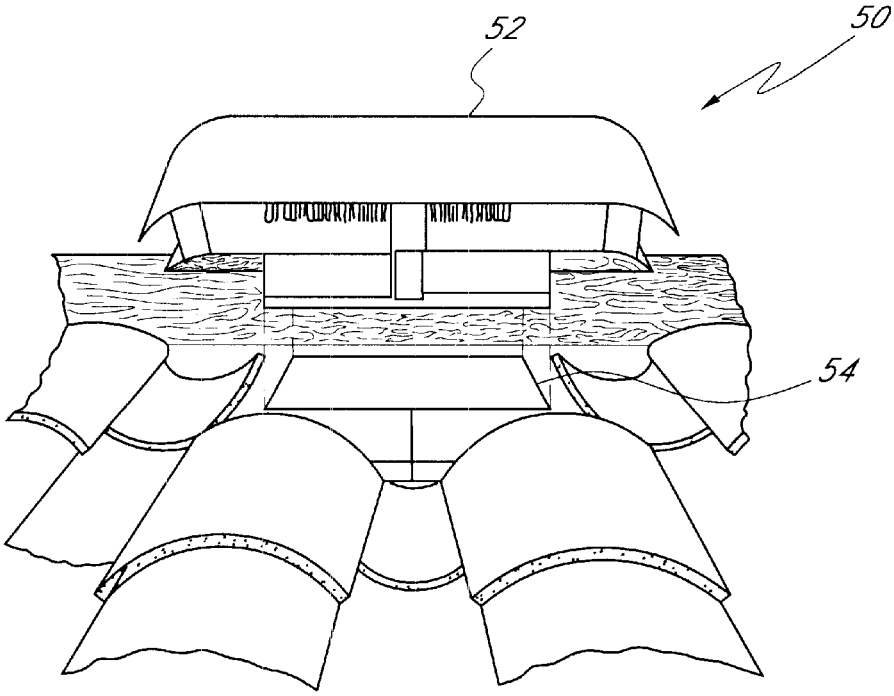
FIG. 3 is a perspective view of a mission-style double-wide vent tile of the roof vent apparatus of this invention illustrating the vent cap being inserted over the vent base.

FIG. 3 is a perspective view of a mission-style double-wide vent tile 50 of the roof vent apparatus of this invention illustrating the vent cap 52 being inserted over the vent base 54. Such double-wide styles are typically installed at the roof ridgeline only.

Figure 4:
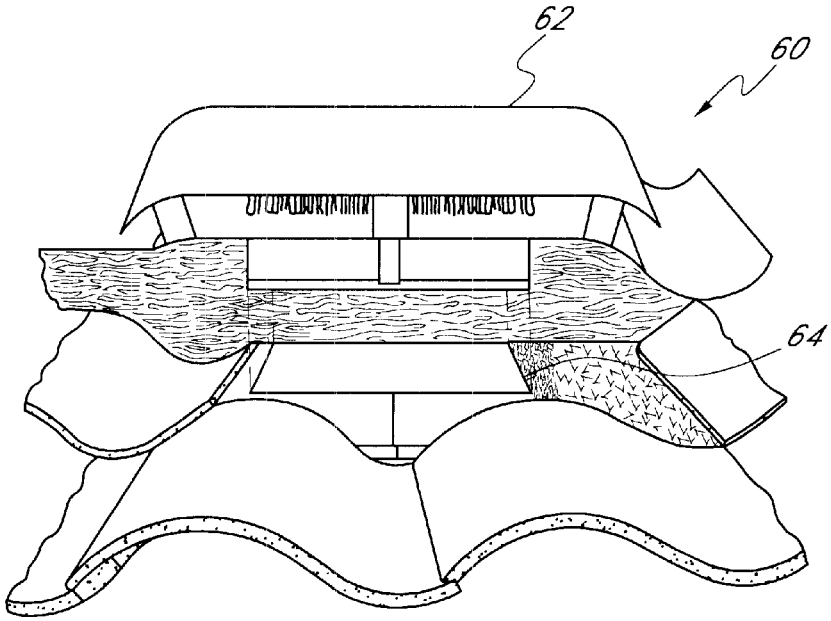
FIG. 4 is a perspective view of an S-style double-wide vent tile of the roof vent apparatus of this invention illustrating the vent cap being inserted over the vent base.

FIG. 4 is a perspective view of an S-style double-wide vent tile 60 of the roof vent apparatus of this invention illustrating the vent cap 62 being inserted over the vent base 64.

Figure 5:
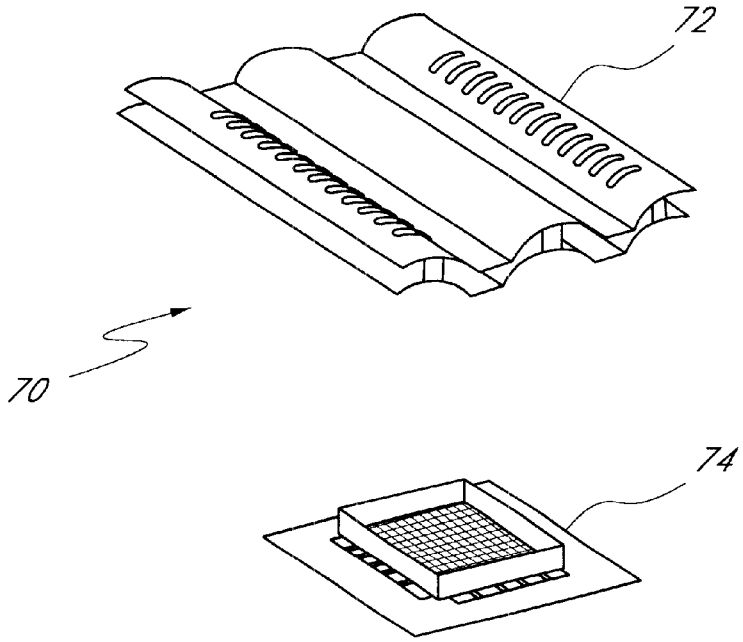
FIG. 5 is a perspective view of a villa-style (field) vent tile of the roof vent apparatus of this invention illustrating the vent cap and associated vent base.

FIG. 5 is a perspective view of a villa-style (field) vent tile 70 of the roof vent apparatus of this invention illustrating the vent cap 72 and associated vent base 74.

Figure 6:
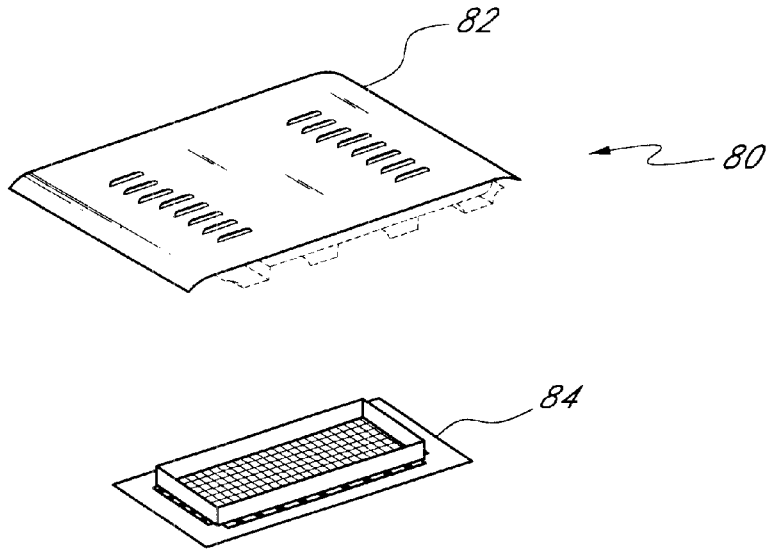
FIG. 6 is a perspective view of a villa-style double-wide (ridgeline) vent tile of the roof vent apparatus of this invention illustrating the vent cap and associated vent base.

FIG. 6 is a perspective view of a villa-style double-wide (ridgeline) vent tile 80 of the roof vent apparatus of this invention illustrating the vent cap 82 and associated vent base 84.

Figure 7:
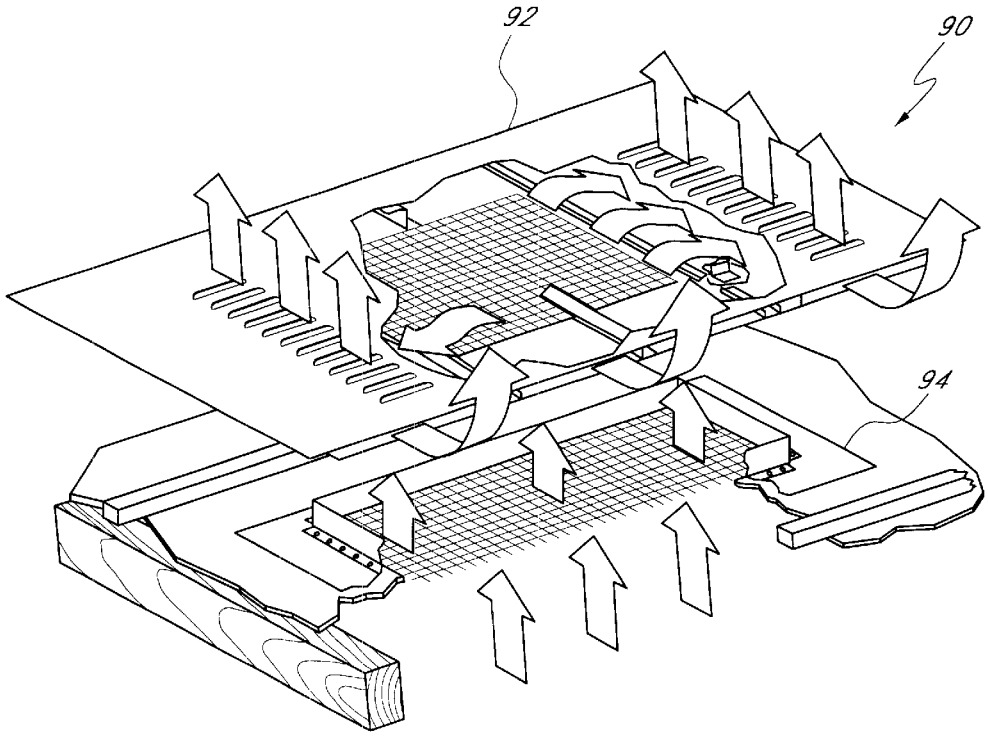
FIG. 7 is a perspective view of a flat-style double vent tile of the roof vent apparatus of this invention, illustrating the vent cap aligned over the vent base, and the air flow from the attic through the vent.

FIG. 7 is a perspective view of a flat-style double vent tile 90 of the roof vent apparatus of this invention, illustrating the vent cap 92 aligned over the vent base 94, and the air flow from the attic through the vent.

Figure 8:
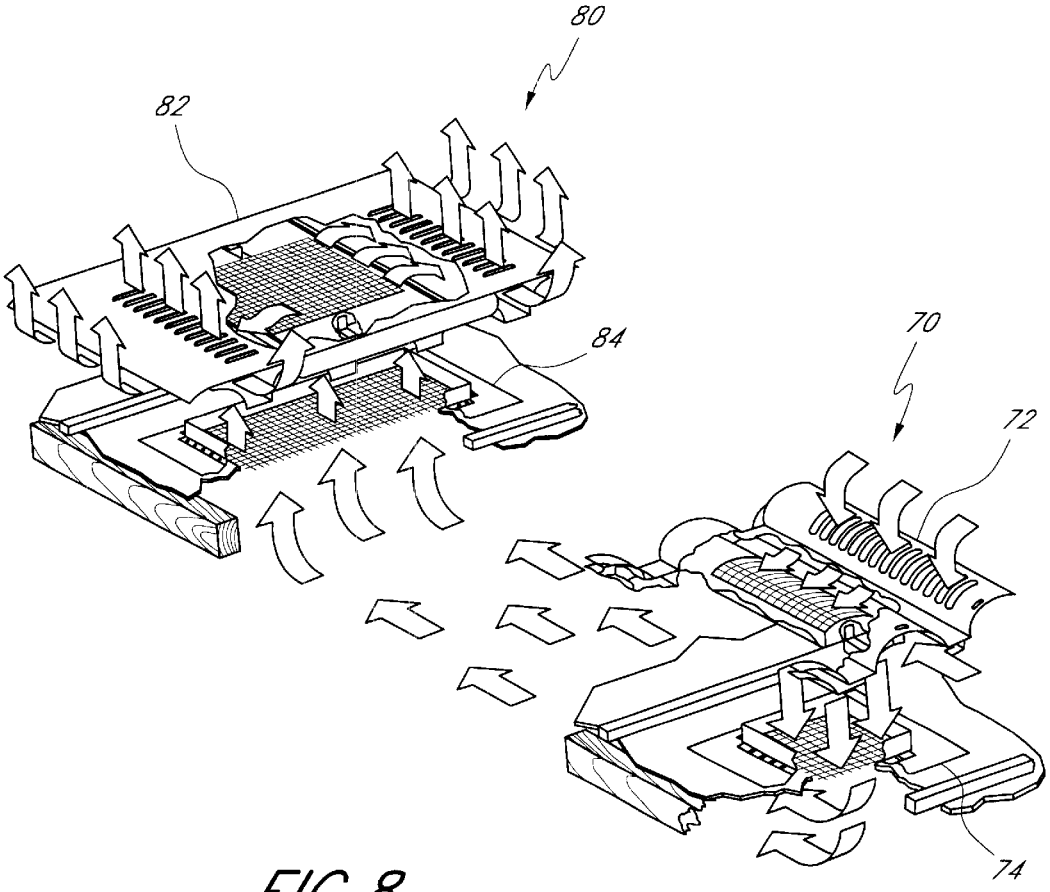
FIG. 8 is an illustration of the air flow pattern in an attic volume with a roof bearing a field vent and a ridgeline vent.

FIG. 8 is an illustration of the air flow pattern in an attic volume with a roof bearing a field vent 70 and a ridgeline vent 80 (analogous to those styles illustrated in FIGS. 5 and 6, respectively).

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A vent for installation in a roof having a roof deck covered by a plurality of roof tiles having upper and lower surfaces, comprising:

a vent base for mounting in an opening in said roof deck below said plurality of roof tiles, said vent base having an opening covered by a screen, to provide air flow through said roof deck opening;

a vent cap shaped like said roof tiles having an upper cap surface generally conforming to and adapted to be mounted among said plurality of roof tiles over said roof deck opening, said cap having a lower cap surface spaced apart from said upper cap surface, said lower cap surface including a screen covering an opening therein and adapted to be spaced from said vent base wherein, when said roof vent is installed to generally conform in appearance to at least one of said roof tiles, the resulting air path will cause air flow through said screen covered openings in said roof deck and said vent base, through the screen covered opening in said lower cap surface, and under and around said upper cap surface to the exterior of said roof.

2. A vent in accordance with claim 1 wherein the vent cap is inserted over the vent base.

3. A vent in accordance with claim 1 wherein the vent cap is aligned over the vent base.

4. A vent in accordance with claim 1 wherein the vent cap is associated with the vent base.

5. A vent in accordance with claim 1 wherein said upper surface conforms in shape to the upper surface of two tiles.

6. A vent in accordance with claim 1 where in the upper surface of said vent cap includes at least one opening covered by a screen, said vent cap upper surface opening being vertically off-set from said lower cap surface screen.

7. A vent in accordance with claim 1 wherein the vent is formed of clay or concrete.

8. A vent in accordance with claim 6 wherein said at least one opening is formed by louver, screen or a plurality of holes.

9. A roof system including a roof deck and comprising a plurality of vents and roof tiles, each vent comprising:

a vent base for mounting in an opening in said roof deck below said plurality of roof tiles, said vent base having an opening covered by a screen, to provide air flow through said roof deck opening;

a vent cap shaped like said roof tiles having an upper cap surface generally conforming to and adapted to be mounted among said plurality of roof tiles over said roof deck opening, said cap having a lower cap surface spaced apart from said upper cap surface, said lower cap surface including a screen covering an opening therein and adapted to be spaced from said vent base wherein, when each said roof vent is installed to generally conform in appearance to at least one of said roof tiles, the resulting air path will cause air flow through said screen covered openings in said roof deck and said vent base, through the screen covered opening in said lower cap surface, and under and around said upper cap surface to the exterior of said roof.

10. A roof system in accordance with claim 9 wherein the plurality of roof vents includes at least one vent at the eave and at least one vent at the ridge line.

* * * * *